US005469646A

United States Patent [19]

Takamura

[11] Patent Number: 5,469,646

[45] Date of Patent: Nov. 28, 1995

[54] FINE OPERATION MODE CHANGEOVER DEVICE FOR HYDRAULIC EXCAVATOR

[75] Inventor: Fujitoshi Takamura, Osaka, Japan

[73] Assignee: Kabushiki Kaisha Komatsu Seisakusho, Tokyo, Japan

[21] Appl. No.: 211,251

[22] PCT Filed: Sep. 25, 1992

[86] PCT No.: PCT/JP92/01226

§ 371 Date: Mar. 24, 1994

§ 102(e) Date: Mar. 24, 1994

[87] PCT Pub. No.: WO93/06315

PCT Pub. Date: Apr. 1, 1993

[30] Foreign Application Priority Data

Sep. 27, 1991 [JP] Japan ..... 3-086381

[51] Int. Cl.[6] ..... G05D 1/04

[52] U.S. Cl. ..... 37/382; 414/699; 364/424.07; 172/2

[58] Field of Search ..... 37/382, 348, 414; 414/699; 172/2, 3; 364/424.07; 60/428, 452; 91/447

[56] References Cited

U.S. PATENT DOCUMENTS

| | | | |
|---|---|---|---|
| 4,606,313 | 8/1986 | Izumi et al. | 414/699 X |
| 4,643,146 | 2/1987 | Spriessler | 414/699 X |
| 4,776,751 | 10/1988 | Saele | 414/699 |
| 4,833,798 | 5/1989 | Ehrich | 37/414 |
| 4,838,755 | 6/1989 | Johnson et al. | 414/699 |
| 4,838,756 | 6/1989 | Johnson et al. | 414/699 |
| 4,889,466 | 12/1989 | Jindai et al. | 414/699 X |
| 4,989,567 | 2/1991 | Fujioka | 414/699 X |
| 5,019,989 | 5/1991 | Ueda et al. | 364/431.05 |
| 5,062,350 | 11/1991 | Tanaka et al. | 414/699 X |
| 5,073,865 | 12/1991 | Togai et al. | 364/426.02 X |
| 5,151,861 | 9/1992 | Danno et al. | 364/426.02 |
| 5,197,008 | 3/1993 | Itoh et al. | 364/426.01 |
| 5,297,649 | 3/1994 | Yamamoto et al. | 172/3 X |

FOREIGN PATENT DOCUMENTS

| | | |
|---|---|---|
| 62-114951 | 7/1987 | Japan . |
| 62-220703 | 9/1987 | Japan . |
| 2-217530 | 8/1990 | Japan . |
| 2279837 | 11/1990 | Japan . |
| 2-291435 | 12/1990 | Japan . |

*Primary Examiner*—David H. Corbin
*Assistant Examiner*—Victor Batson
*Attorney, Agent, or Firm*—Richards, Medlock & Andrews

[57] ABSTRACT

A hydraulic excavator adapted to be changed over simply to a fine operation mode so as to control the capacity of a hydraulic pump through load-sensing control to thereby make it possible to perform accurate work when the machine needs to be finely operated temporarily for operations such as ground levelling, and position adjustment on a dump vessel, wherein the fine operation mode is easily cleared to switch the excavator to a standard mode to thereby improve operability, as well as work efficiency. When the excavator is switched to the fine operation mode so as to control the capacity of the hydraulic pump through load-sensing control for accurate work, the engine is driven at such a torque and engine revolution as permitting a minimum fuel consumption, thus reducing the fuel consumption of the engine.

20 Claims, 7 Drawing Sheets

FINE OPERATION MODE CHANGEOVER DEVICE FOR HYDRAULIC EXCAVATOR

BACKGROUND OF THE INVENTION

1. Field of the Invention

The present invention relates to a fine operation mode changeover device for a hydraulic excavator which is intended to enable performance of accurate operation by simply changing over the operation to a fine operation mode when fine control of operation of a working machine such as a hydraulic excavator is provisionally required, for example, in leveling of a ground surface and in position adjustment on a dump vessel, and easy cancellation of the fine operation mode of the hydraulic excavator for returning to normal operation, thereby improving operability and work efficiency of the machine.

2. Description of the Related Art

When temporary fine control of the operation is required in such work as ground leveling by a hydraulic excavator or position adjustment on a dump vessel, such fine operation can be carried out with a far smaller quantity of fuel than in typical excavating work. Therefore, an engine revolution rate at a specified torque $T_0$ is controlled to $N_1$, $N_2$ or $N_3$ (rev/min) and a required quantity of fuel, that is, $V.N_1$, $V.N_2$ or $V.N_3$ (cc/min), while maintaining a capacity V (cc/rev) of a hydraulic pump to be driven by the engine at a fixed level, is controlled by reducing a fuel injection quantity as shown in an engine torque graph in FIG. 8, thereby reducing fuel consumption of the engine. As is well known, an absorption torque T of the hydraulic pump is denoted as $T=kP\times V$ wherein k is a proportional constant and P is a load pressure. If the capacity V (cc/rev) of the hydraulic pump is fixed, the load pressure $P_0$ of the hydraulic pump, having the absorption torque $T_0$ illustrated in FIG. 8, is proportional to the absorption torque $T_0$. An oil quantity of a hydraulic pump is reduced by a method which reduces the capacity V of the hydraulic pump by fixing a fuel injection to the engine as shown in FIG. 9 (the rotation rate of the engine is approximately fixed) and changing over the operation of the working machine to the fine operation mode. However, in the case of a method for reducing the oil quantity of the hydraulic pump by decreasing the rotation rate of the engine from the engine rotation note $N_1$, in a state where the capacity V of the hydraulic pump is kept fixed as shown in FIG. 8, the matching points A2, A3 for the lower engine rotation rates $N_2$, $N_3$, respectively, with the absorption torque $T_0$ corresponding to a specified load are further away from the center of the equivalent fuel consumption efficiency curve FC of the engine (hereinafter referred to as the equivalent fuel consumption curve with 100% at the center) than the matching point $A_1$ for the initial engine rotation $N_1$, and therefore this method is disadvantageous in that the fuel consumption of the engine lowers accordingly and the operator will suffer from a great deal of fatigue in frequently repeated operations for adjusting the rotation rate of the engine during the work by the hydraulic excavator. In the method as shown in FIG. 9, assuming that k is a proportional constant and P is a load pressure, the absorption torque T of the pump is denoted as $T=kP\times V$ as described above, and therefore, when the maximum torque is required, reduction of the value V with respect to the maximum load pressure P set by the relief valve will result in reduction of absorption torque of the hydraulic pump from $T_S$ to $T_1$. Accordingly, this method is also disadvantageous in that the matching point with the hydraulic pump is shifted from $A_S$ to $A_1$, which is further away from the center of the equivalent fuel consumption curve FC of the engine. Therefore, the fuel consumption efficiency of the engine deteriorates due to the location of the matching point $A_1$ being further from the center of the equivalent fuel consumption curve FC than is the location of the matching point $A_S$. The operating valves should be controlled in a small range where the operating strokes of operating valves are small, and the operability is deteriorated since only an insufficient capacity of the hydraulic pump can be obtained from the reduced absorption torque $T_1$ of the hydraulic pump because the load sensing control is not effected. As shown in FIG. 8, frequent changeover operations of the fine operation mode and the ordinary operation mode will bring about a considerable degree of fatigue to the operator.

SUMMARY OF THE INVENTION

A fine operation mode changeover device for a hydraulic excavator in accordance with the present invention comprises a variable capacity type hydraulic pump, an actuator to be driven by the above described hydraulic pump, an operating valve provided in a conduit between the hydraulic pump and the actuator, a load sensing control unit for the hydraulic pump, a fine operation mode changeover switch, and a controller which receives a changeover signal from the fine operation mode changeover switch and outputs a differential pressure signal of upper and lower streams of the operating valve, wherein a load sensing differential pressure signal from the controller is not outputted to the load sensing control unit since the fine operation mode changeover switch is not operated when the actuator of the hydraulic excavator is driven in a routine operation mode and the differential pressure between the upper stream and the lower stream of the operating valve is controlled to be a fixed differential pressure preset in the load sensing control unit. When a changeover signal from the fine operation mode changeover switch is entered into the controller to drive the actuator of the hydraulic excavator in the fine operation mode, the load sensing differential pressure signal from the controller is outputted to the load sensing control unit so as to reduce the capacity of the hydraulic pump through the capacity control cylinder.

The device in accordance with the present invention also comprises a variable capacity type hydraulic pump, an engine for driving the hydraulic pump, an actuator to be driven by the hydraulic pump, an operating valve provided in a conduit between the hydraulic pump and the actuator, a load sensing control unit, a fine operation mode changeover switch, and a controller which receives a changeover signal from the fine operation mode changeover switch and outputs a fuel injection quantity signal to a governor drive unit and a differential pressure signal of upper and lower streams of the operating valve, wherein a load sensing differential pressure signal from the controller is not outputted to the load sensing control unit since the fine operation mode changeover switch is not operated when the actuator of the hydraulic excavator is driven in a routine operation mode and the differential pressure between the upper stream and the lower stream of the operating valve is controlled to be a fixed high differential pressure preset in the load sensing control unit and simultaneously the horsepower of the engine rises up to a preset high horsepower. Accordingly, the capacity of the variable capacity type hydraulic pump increases and the rotation rate of the engine in reference to the specified torque is increased owing to the rise of the horsepower, and therefore the discharge per unit time of the variable capacity type hydraulic pump increases. When the fine operation mode changeover switch is operated to drive the hydraulic excavator in the fine operation mode, a low fuel injection quantity signal from the controller is outputted to the governor drive unit of the engine to reduce the horsepower of the engine and the differential pressure signal which seems to reduce the differential pressure between the upper and lower streams of the operating valve for the actuator is outputted to the load sensing control valve, and therefore the capacity of the variable capacity type hydraulic pump in reference to the specified amount of operation of the operating valve for the actuator reduces. Accordingly, the capacity of the variable capacity type hydraulic pump decreases and the rotation rate of the engine in reference to the specified torque is decreased owing to the reduction of the horsepower, and therefore the discharge per unit time of the variable capacity type hydraulic pump decreases.

The load sensing control unit is adapted to decrease the capacity of the hydraulic pump through the capacity control cylinder of the hydraulic pump according to the increase of the differential pressure signal to be outputted from the controller and to increase the capacity of the hydraulic pump through the capacity control cylinder of the hydraulic pump according to the decrease of the differential pressure signal. The load sensing control unit decreases the capacity of the hydraulic pump through the capacity control cylinder of the hydraulic pump when the differential signal outputted from the controller increases, and increases the capacity of the hydraulic pump through the capacity control cylinder of the hydraulic pump when the differential signal decreases.

The controller is adapted to output a low engine fuel setting signal from the engine fuel setter to the engine fuel signal generator by actuating the engine fuel setter and the load sensing differential pressure setter according to the changeover signal from the fine operation mode changeover switch and a low load sensing differential pressure setting signal from the load sensing differential pressure setter to the load sensing differential pressure signal generator to output a low fuel injection quantity signal from the engine fuel signal generator to the governor drive unit and a low load sensing differential pressure signal to the load sensing control unit and, when the controller receives the changeover signal from the fine operation mode changeover switch, the engine fuel setting device and the load sensing differential pressure setting device are actuated with the changeover signal. When the above described setting devices are actuated, the low engine fuel setting signal is outputted to the engine fuel signal generator and the low load sensing differential pressure setting signal is outputted to the low sensing differential pressure signal generator to output a low fuel injection quantity signal from the engine fuel signal generator to the governor drive unit of the engine and a low load sensing differential pressure signal from the load sensing differential pressure signal generator to the load sensing control unit.

The fine operation mode changeover switch is adapted to be provided on the operation lever of the operating valve. Since the fine operation mode changeover switch is provided on the operation lever of the operating valve, the fine operation mode or the normal operation mode can be easily selected by pushing or releasing the fine operation mode changeover switch even during operation of the working machine.

The device in accordance with the present invention further comprises a variable capacity type hydraulic pump, an actuator to be driven by the hydraulic pump, an operating valve provided in a conduit which connects the hydraulic pump and the actuator, a capacity control cylinder of the hydraulic pump, a fine operation mode changeover switch, a load sensing control unit which changes over the operation to decrease the capacity of the hydraulic pump through the capacity control cylinder owing to an increase of the difference of pilot pressures of the upper and lower streams of the operating valve, and a controller which outputs a specified electrical signal which serves to reduce the capacity of the hydraulic pump through the capacity control cylinder when a changeover signal from the fine operation mode changeover switch is entered, wherein the load sensing control unit, which uses a differential pressure of the upper and lower streams of the operating valve as a pilot pressure, is controlled so that the differential pressure of the upper and lower streams of the operating valve may be maintained at a fixed level through the capacity control cylinder according to the differential pressure of the pilot pressure when the operating valve is operated by the operation lever for driving the actuator of the hydraulic excavator in a standard operation mode. When the changeover signal is entered from the fine operation mode changeover switch into the controller to drive the actuator of the hydraulic excavator in the fine operation mode, a specified electrical signal which reduces the capacity of the hydraulic pump is outputted from the controller to the load sensing control unit through the capacity control cylinder.

Since the specified electrical signal to be outputted from the controller is adapted to be entered into a solenoid of a load sensing valve and reduce the capacity of the hydraulic pump through the capacity control cylinder, the specified electrical signal to be outputted from the controller is entered into the solenoid of the load sensing control unit and serves to reduce the capacity of the hydraulic pump. The device in accordance with the present invention comprises a variable capacity type hydraulic pump, an engine for driving the hydraulic pump, an actuator to be driven by the hydraulic pump, an operating valve provided in a conduit which connects the hydraulic pump and the actuator, a load sensing control unit of the hydraulic pump, a capacity sensor of the hydraulic pump, a rotation rate sensor of the engine, a hydraulic pressure sensor of the actuator, and a fine operation mode changeover switch, and further comprises a controller which receives the signals of the capacity sensor, the rotation rate sensor of the engine and the hydraulic pressure sensor of the actuator, calculates a control signal according to which the engine is driven with the minimum fuel consumption at the specified horsepower designated by the fine operation mode changeover switch and outputs this control signal to the load sensing control unit and the governor drive unit of the engine, wherein the capacity of the variable capacity type hydraulic pump can be reduced for the same operation amount of the operation lever by calculating the control signal according to which the engine is driven with the minimum fuel consumption at the specified horsepower for the fine operation mode stored in the controller, changing over the load sensing control unit according to the control signal and reducing the capacity of the hydraulic pump through the capacity control cylinder when the changeover signal from the fine operation mode changeover switch is entered into the controller to drive the actuator of the hydraulic excavator in the fine operation mode, and the engine can be operated with the minimum fuel consumption for the horsepower reduced by outputting the control signal to the governor drive unit of the engine.

The control signal with which the engine is operated with the minimum fuel consumption is set according to an engine torque and an engine rotation rate which provide the minimum fuel consumption on the equivalent horsepower curve of the engine and therefore the engine is operated with the engine torque and the engine rotation rate which provide the minimum fuel consumption on the equivalent horsepower curve.

The fine operation mode changeover switch is provided on the operation lever of the actuator to permit easy changing over of the fine operation mode and the standard operation mode by pushing and releasing the fine operation mode changeover switch even during operation of the working machine.

Thus the following effects can be obtained from the present invention. (1) A plurality of operation modes is available by changing over the operation mode. In any operation mode, a required flow rate can be ensured and the engine can be operated with the minimum fuel consumption since the rotation rate of the engine can be set independently of the adjustment of the capacity of the hydraulic pump by adjusting the capacity of the hydraulic pump according to the load sensing control. (2) The operability by the operator can be improved by load sensing control of the capacity of the hydraulic pump so as to operate the operating valve in a wide range. (3) A mode suited for the work can be selected by a simple operation, such as a mere touching of the fine operation mode changeover switch provided on the operation lever, to perform highly accurate operation of the working machine, and the work efficiency can be improved by operating the actuator at a high speed since the operation is immediately changed over to the normal operation mode when the fine operation mode changeover switch is released.

DETAILED DESCRIPTION OF THE PREFERRED EMBODIMENTS

Figure 1:
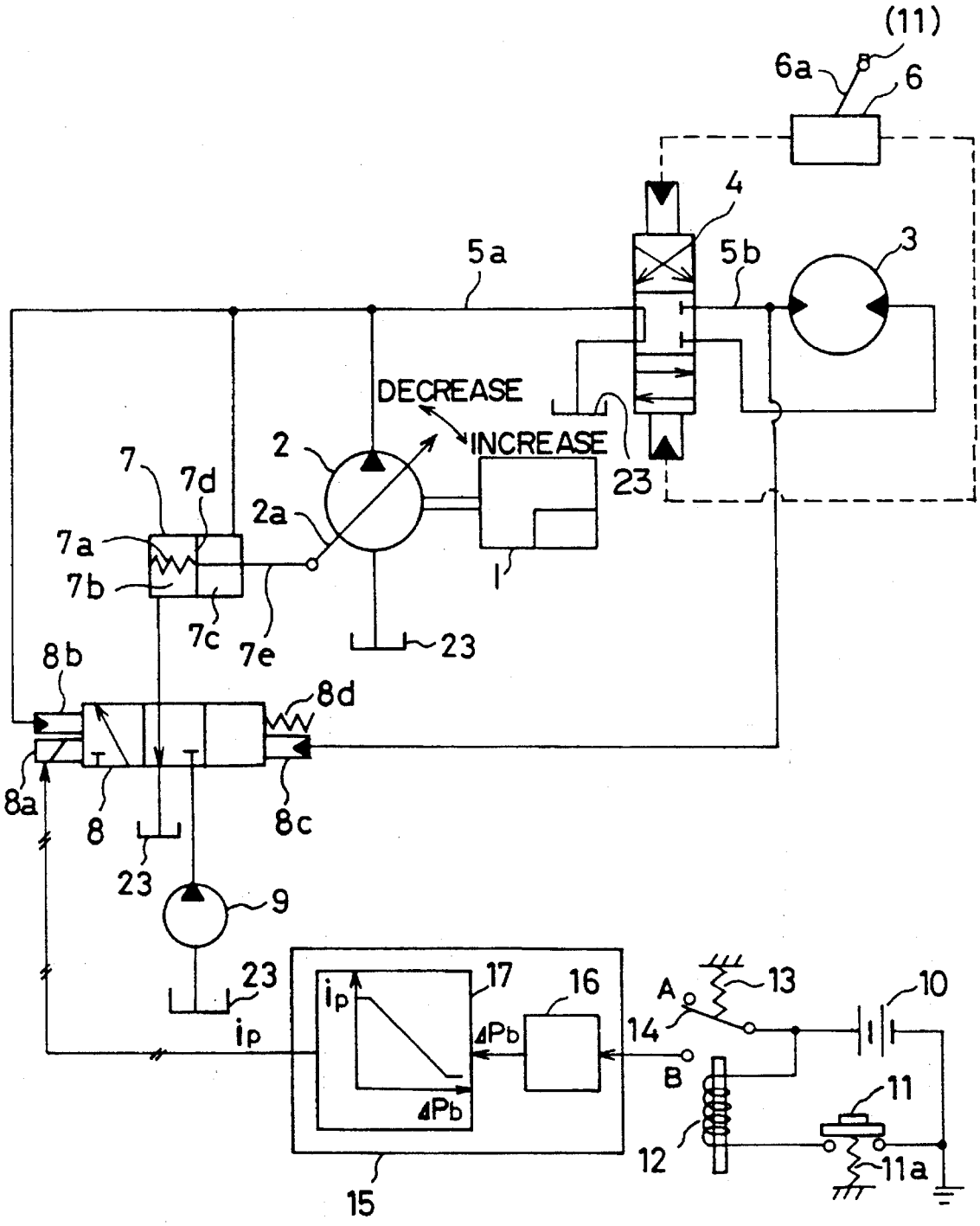
FIG. 1 is a diagram showing a control circuit according to the first embodiment of the present invention.

In FIG. 1 showing a first embodiment of the present invention, 1 is an engine, 2 is a hydraulic pump to be driven by the engine 1, 3 is an actuator of a working machine, 4 is an operating valve provided in conduits 5*a*, 5*b* which connect the hydraulic pump 2 and the actuator 3 of the working machine, 6 is a pilot operating valve for operating the operating valve 4, 6*a* is an operation lever of the pilot operating valve 6, 7 is a capacity control cylinder for driving a diagonal plate 2*a* of the hydraulic pump 2, 7*a* is a spring provided in a bottom chamber 7*b* of the capacity control cylinder 7 to energize a piston 7*d* in a direction toward a rod chamber 7*c*, 7*e* is a piston rod for coupling the piston 7*d* to the diagonal plate 2*a*, 8 is a load sensing control unit for changing over the control pressure of the capacity control cylinder 7, 8*a* is a solenoid of a load sensing valve 8 connected to a controller 15, 8*b* is a pilot cylinder of the load sensing valve 8 connected to an upper stream conduit 5*a* of the operating valve 4, 8*c* is a pilot cylinder of the load sensing control unit 8 connected to a lower stream conduit 5*b* of the operating valve 4, 8*d* is a differential pressure setting spring of a load sensing valve 8, 9 is a control pump as a control pressure source of the capacity control cylinder 7, 10 is a power source, 11 is a fine operation mode changeover switch, 11*a* is a return spring of the fine operation mode changeover switch 11, 12 is a magnet, 13 is a spring, 14 is a changeover switch, and 15 is a controller which enters a changeover signal from the changeover switch 14 and outputs a differential pressure signal i*p* of upper and lower streams of the operating valve 4 to the solenoid 8*a* of the load sensing control unit 8. The controller 15 comprises a load sensing differential pressure setter 16 and a load sensing differential pressure signal generator 17. 23 is a tank.

An operation of a configuration shown in FIG. 1 is described below. In an operation of the hydraulic excavator in a normal operation mode, the voltage of the power supply 10 is not applied to the magnet 12 since the fine operation mode changeover switch 11 is not pressed, and therefore the magnet 12 is demagnetized and the changeover switch 14 is connected with the contact A by the spring 13. Accordingly, the voltage of the power supply 10 is not applied to the load sensing differential pressure setter 16 in the controller 15, and therefore the load sensing differential pressure signal $i_p$ is not outputted from the load sensing differential pressure signal generator 17 to the solenoid 8*a* of the load sensing control unit 8. Accordingly, the load sensing control unit 8 operates to provide a high load sensing differential pressure which is determined by a preset spring 8*d*. As described above, since the operation in a normal operation mode is carried out with a high rotation rate of the engine and a high capacity of the hydraulic pump, the discharge of the hydraulic pump per unit time increases and the actuators can be operated at high speeds to improve the working efficiency. For changing over the operation to the fine operation mode during the normal operation mode, the voltage of the power supply 10 is applied to the magnet 12 and the changeover switch 14 is connected to the contact B when the fine operation mode changeover switch 11 is pressed. The voltage of the power supply 10 is applied to the load sensing differential pressure setter 16 in the controller 15 and, when a low load sensing differential pressure setting signal $\Delta P_b$ is outputted from the load sensing differential pressure setter 16 to the load sensing differential pressure signal generator 17, the load sensing differential pressure signal generator 17, which serves as a decreasing function generator, outputs the load sensing differential pressure signal $i_p$ corresponding to the low load sensing differential pressure setting signal $\Delta P_b$ to the solenoid 8*a* of the load sensing control unit 8, and therefore the capacity of the hydraulic pump 2 is reduced for the same operation amount of the operating valve 4. Since the discharge of the hydraulic pump 2 per unit time decreases as described above even though the rotation of the engine is constant, fine operation will be easy. In this first embodiment, the device is simplified in its construction and the operating valve can be controlled in a wide range of operation, and it is therefore advantageous in that the operability can be improved and the changeover of the modes is easy. However, the measures for reducing fuel consumption of the engine have not been taken.

Figure 2:
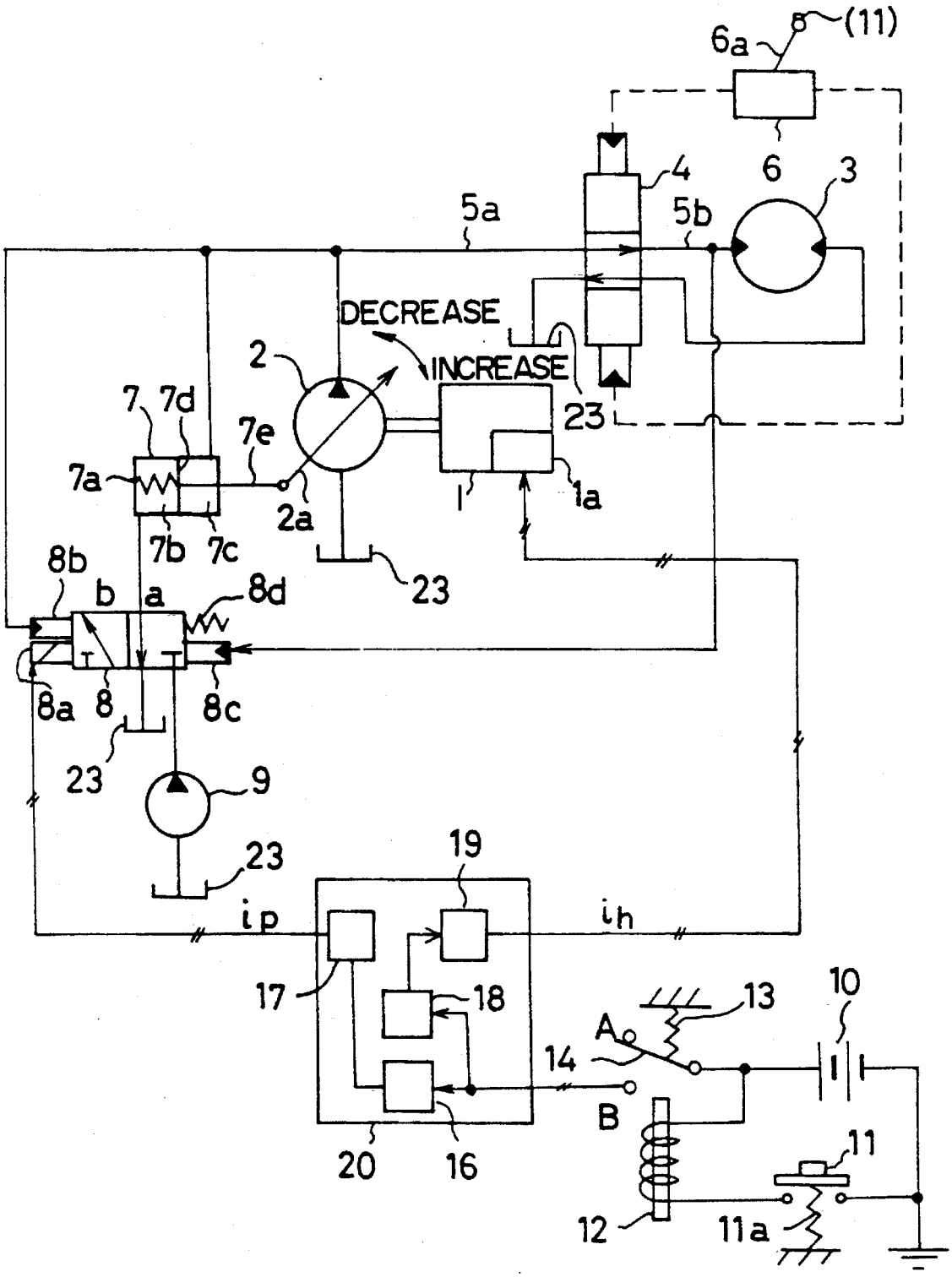
FIG. 2 is a diagram showing a control circuit according to the second embodiment of the present invention.
Figure 3:
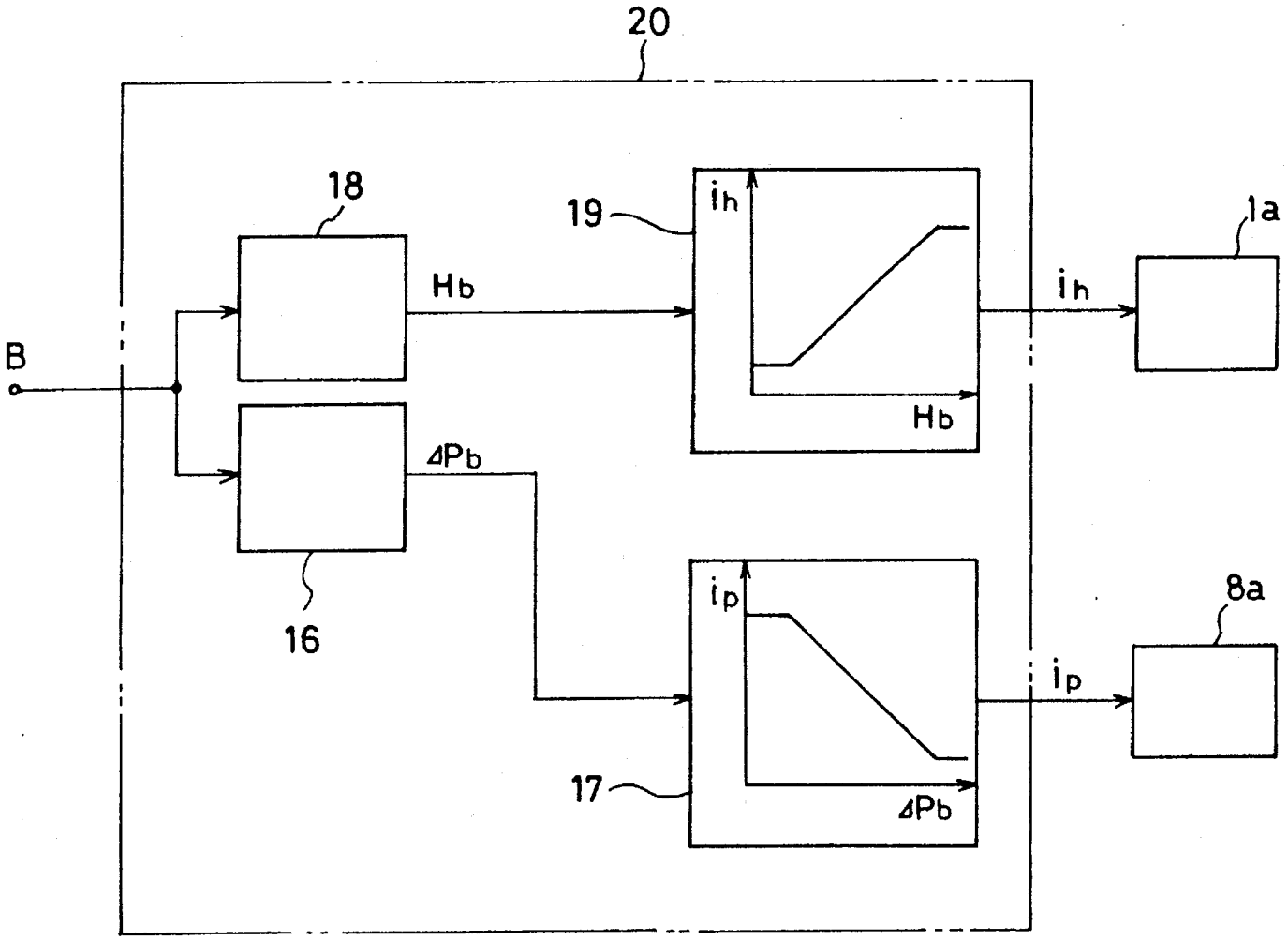
FIG. 3 is a diagram showing the details of the controller shown in FIG. 2.

In FIGS. 2 and 3 showing a second embodiment of the present invention, the descriptions of the configurations and operations of 1–14, 16, 17 and 23 in FIG. 2 are omitted because of being the same as in FIG. 1. 20 is a controller which comprises the load sensing differential pressure setter 16, the load sensing differential pressure signal generator 17, the engine fuel setter 18 and the engine fuel signal generator 19, receives the changeover signal from the fine operation mode changeover switch 11, outputs the differential pressure signal $i_p$ of upper and lower streams of the operating valve 4 to the solenoid 8*a* of the load sensing control unit 8 and outputs the fuel injection quantity signal $i_h$ to the governor drive unit 1*a* of the engine 1.

The following describes the operation of the configuration shown in FIGS. 2 and 3. In FIG. 2, the fine operation mode changeover switch 11 is not pressed in the operation of the hydraulic excavator in the normal operation mode, and the voltage of the power supply 10 is not applied to the magnet 12; therefore the magnet 12 is demagnetized and the changeover switch 14 is forced to connect to the contact A by the spring 13. Accordingly, the voltage of the power supply 10 is not applied to the load sensing differential pressure setter 16 in the controller 20, and therefore the load sensing differential pressure signal $i_p$ from the sensing differential pressure signal generator 17 is not outputted to the solenoid 8*a* of the load sensing control unit 8 and the fuel injection quantity signal $i_h$ from the engine fuel signal generator 19 is not outputted to the governor drive unit 1*a* of the engine 1. Accordingly, the load sensing control valve 8 provides a high load sensing differential pressure which is determined by the preset spring 8*d*, and the governor drive unit 1*a* of the engine 1 is operated with a preset high fuel injection quantity. As described above, since the operation in a normal operation mode is carried out with a high rotation rate of the engine and a high capacity of the hydraulic pump, the discharge of the hydraulic pump per unit time increases and the actuators can be operated at high speeds to improve the working efficiency. For changing over the operation to the fine operation mode during the normal operation mode, the voltage of the power supply 10 is applied to the magnet 12 and the changeover switch 14 is connected to the contact B when the fine operation mode changeover switch 11 is pressed. The voltage of the power supply 10 is applied to the load sensing differential pressure setter 16 in the controller 20 and, when a low load sensing differential pressure setting signal $\Delta P_b$ is outputted from the load sensing differential pressure setter 16 to the load sensing differential pressure signal generator 17, the load sensing differential pressure signal generator 17, which serves as a decreasing function generator, outputs the load sensing differential pressure signal $i_p$ corresponding to the low load sensing differential pressure setting signal $\Delta P_b$ to the solenoid 8*a* of the load sensing control unit 8, and therefore the capacity of the hydraulic pump 2 is reduced for the same operation amount of the operating valve 4. Since the voltage of the power supply 10 is applied to the engine fuel setter 18 in the controller 20, when a low engine fuel setting signal $H_b$ from the engine fuel setter 18 is outputted to the engine fuel signal generator 19, the engine fuel signal generator 19, which serves as an increasing function generator, outputs a low engine fuel signal $i_h$ corresponding to the low engine fuel setting signal $H_b$ to the governor drive unit 1*a* of the engine 1 and the rotation rate of the engine is reduced. As described above, the operation is carried out with a low rotation rate of the engine and a low capacity of the hydraulic pump in the fine operation mode and therefore the discharge of the hydraulic pump 2 per unit time decreases and fine operation can be easily carried out.

Figure 4:
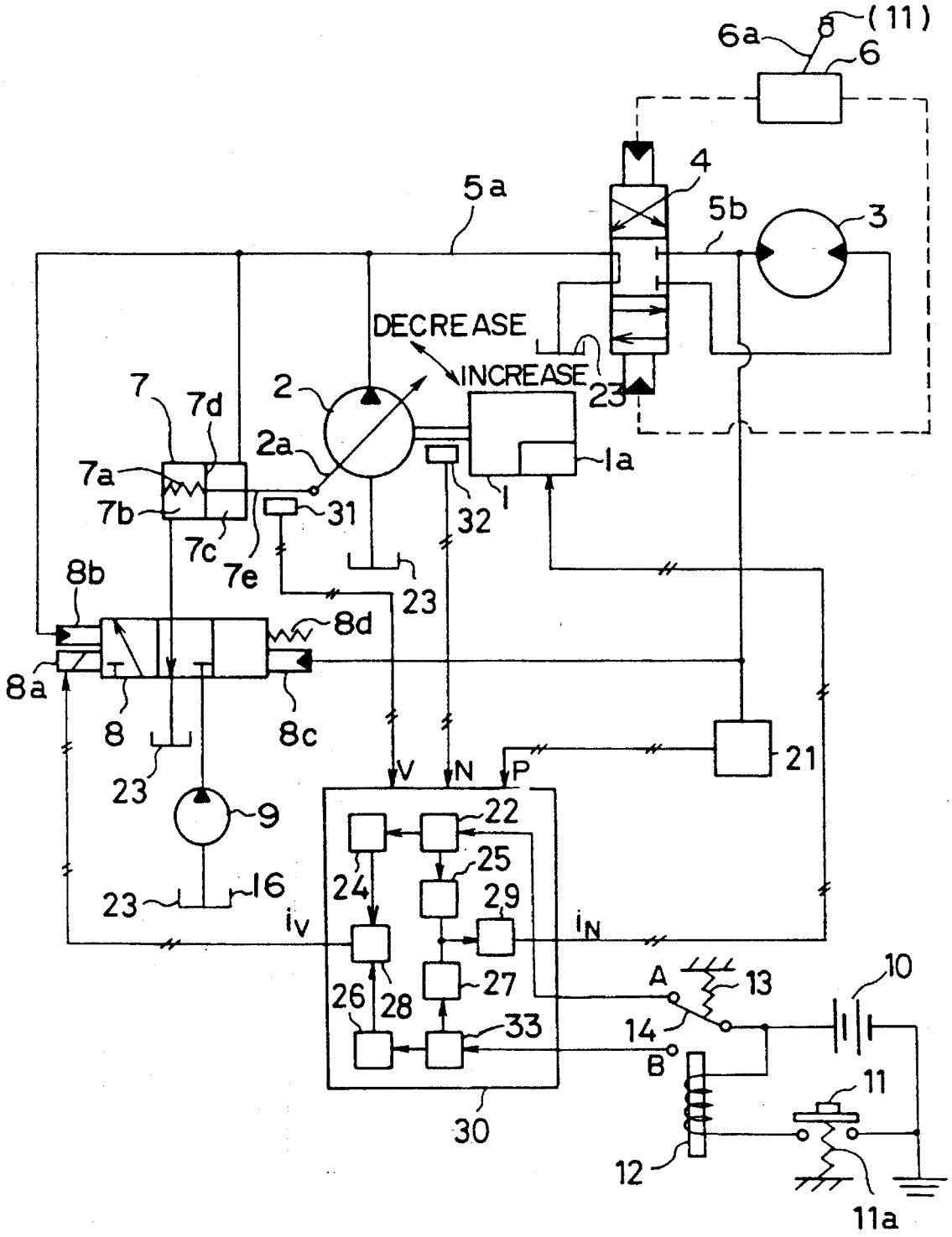
FIG. 4 is a diagram showing a control circuit according to the third embodiment of the present invention.
Figure 5:
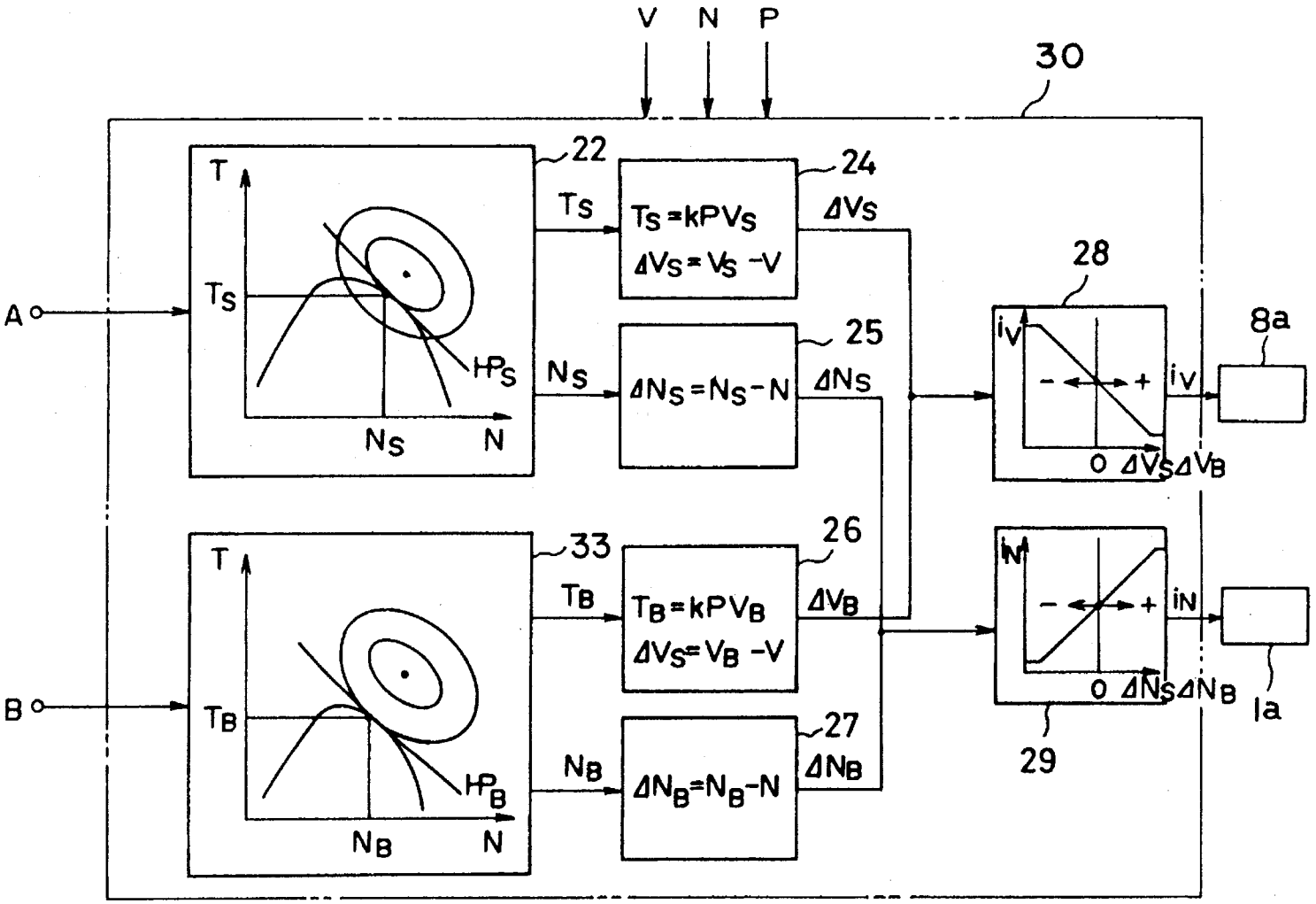
FIG. 5 is a diagram showing the details of the controller shown in FIG. 4.

In FIGS. 4 and 5 showing a third embodiment of the present invention, the descriptions of the configuration and operations of 1–14 and 23 in FIG. 4 are omitted because of being the same as in FIG. 1. 21 is a hydraulic sensor for converting a hydraulic pressure of a lower stream conduit 5*b* of the operating valve 4 to an electrical signal, 31 is a pump capacity sensor for detecting the capacity of the hydraulic pump 2, 32 is an engine rotation rate sensor for detecting a rotation rate of the engine 1, and 30 is a controller which receives the detection signals and the command signals from the hydraulic sensor 21 of the actuator 3, the operation mode changeover switch 11, the pump capacity sensor 31 of the hydraulic pump 2 and the engine rotation rate sensor 32 of the engine 1, calculates the control signals $i_N$ and $i_V$ according to which the engine 1 is operated with the minimum fuel consumption and the specified horsepower assigned by the operation mode changeover switch 11 and outputs the control signal $i_N$ to the governor drive unit 1*a* of the engine 1 and the control signal $i_V$ to the solenoid 8*a* of the load sensing valve 8. This controller 30 includes a target value setter 22 for setting a target engine rotation rate $N_S$ and a target engine torque $T_S$ for the standard operation mode, a capacity difference calculator 24 for calculating a difference $\Delta V_S$ between the target capacity $V_S$ calculated from the target engine torque $T_S$ and a detection value P of the hydraulic sensor 21 and a detection value V of the capacity sensor 31, and an engine rotation rate difference calculator 25 for calculating a difference $\Delta N_S$ between the target engine rotation rate $N_S$ and an actual engine rotation rate N detected by the engine rotation rate sensor 32. Similarly for the fine operation mode, the controller 30 includes a target value setter 33 for setting a target engine rotation rate $N_B$ and a target engine torque $T_B$ for the fine operation mode, a capacity difference calculator 26 for calculating a difference $\Delta V_B$ between the target capacity $V_B$ calculated from the target engine torque $T_B$ and a detection value P of the hydraulic sensor 21 and a detection value V of the capacity sensor 31, and an engine rotation rate difference calculator 27 for calculating a difference $\Delta N_B$ between the target engine rotation rate $N_B$ and an actual engine rotation rate N detected by the engine rotation rate sensor 32. In addition, the controller 30 includes a control signal generator 28 for converting the capacity difference signal $\Delta V_S$ or $\Delta V_B$ to a control signal $i_V$ to be applied to the solenoid 8*a*, and a control signal generator 29 for converting the engine rotation rate difference signal $\Delta N_S$ or $\Delta N_S$ to a control signal $i_N$ to be applied to the governor drive unit 1*a*.

An operation of a configuration shown in FIGS. 4 and 5 is described below. For operation of the hydraulic excavator in the standard operation mode, the changeover switch 14 is connected to the contact A unless the fine operation mode changeover switch 11 is pressed, and the target engine rotation rate $N_S$ and the target engine torque $T_S$ and the detection value P of the hydraulic sensor are entered into the capacity difference calculator 24 by the target value setter 22 in the controller 30. As is well known, assuming that k is a proportional constant, the target engine torque $T_S$ can be denoted as $T_S=kPV_S$, and therefore the target pump capacity $V_S$ is calculated and the difference $\Delta V_S$ between the target pump capacity $V_S$ and the detection value V of the pump capacity sensor 31 is calculated. When the signal of the capacity difference $\Delta V_S$ is outputted to the control signal generator 28, the control signal $i_V$ corresponding to the capacity difference signal $\Delta V_S$ as shown is outputted to the solenoid 8a of the load sensing valve 8. If the capacity difference signal $\Delta V_S$ is small in the control signal generator 28, the control signal $i_V$ is set to have a large value. For example, if the actual pump capacity V to be detected by the pump capacity sensor 31 is excessively large for the target pump capacity $V_S$ , the capacity difference signal $\Delta V_S$ becomes small and the control signal $i_V$ becomes large, and therefore the energizing force of the solenoid 8a which pushes the load sensing valve 8 rightwardly becomes large. Accordingly, the control pressure of the control pump 9 is supplied to the bottom chamber 7b of the capacity control cylinder 7, and a piston rod 7e of the capacity control cylinder 7 moves to the right side to control the diagonal plate 2a of the variable capacity type hydraulic pump 2 in a direction where the capacity is decreased. Thus the capacity is controlled so that the capacity difference signal $\Delta V_S$ is 0, that is, the actual pump capacity V becomes the target pump capacity $V_S$. Similarly, when the target engine rotation rate $N_S$ set by the target value setter 22 and the actual engine rotation rate N detected from the engine rotation rate sensor 32 are entered into the engine rotation rate difference calculator 25, a difference $\Delta N_S$ between the target engine rotation rate $N_S$ and the actual engine rotation rate N detected by the engine rotation rate sensor 32 is calculated. If the engine rotation rate difference signal $\Delta N_S$ is small in the control signal generator 29, the control signal $i_N$ is set to have also a small value. For example, if the actual engine rotation rate N detected by the engine rotation rate sensor 32 is excessively small for the target engine rotation rate $N_S$, the value of each of the engine rotation rate difference signal $\Delta N_S$ and the control signal $i_N$ becomes large. Therefore, the capacity is controlled so that the governor drive unit moves to a larger stroke to cause more fuel to be injected and the engine rotation rate N to increase. The engine rotation rate difference signal $\Delta N_S$ becomes 0, that is, the actual engine rotation rate N becomes the target engine rotation rate $N_S$. Thus, excavation work can be carried out at the target engine rotation rate $N_S$ and the target engine torque $T_S$ with which the minimum fuel consumption can be achieved. For operation of the hydraulic excavator in the fine operation mode, the changeover switch 14 is connected to the contact B when the fine operation mode changeover switch 11 is pressed and the target engine rotation rate $N_B$ and the target engine torque $T_B$ are set by the target setter 33 in the controller 30, and the excavation work in the fine operation mode can be carried out, as in the standard operation mode, with the target engine rotation rate $N_B$ and the target engine torque $T_B$ with which the minimum fuel consumption can be achieved. For changing over the operation to the standard operation mode during the fine operation mode, the fine operation mode changeover switch 11 which is kept depressed should be released. Then the changeover switch 14 is changed over to the contact A and the machine can be immediately released from the fine operation mode and changed over to the standard operation mode.

Figure 6:
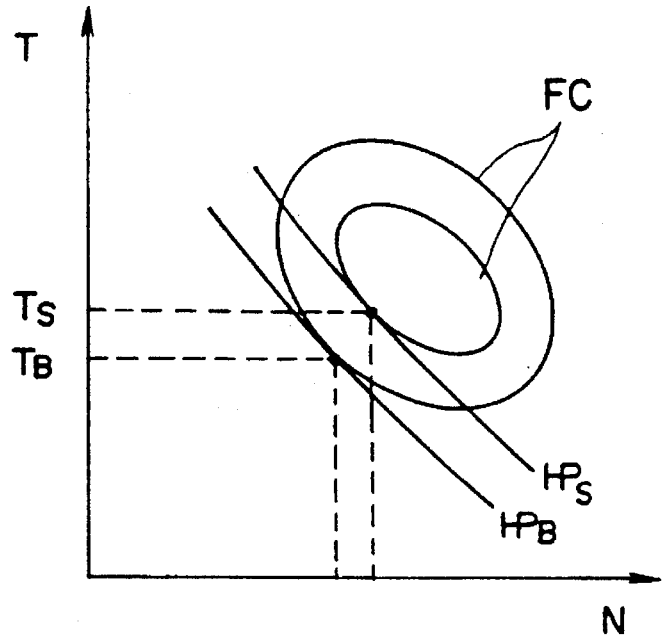
FIG. 6 is a diagram showing equivalent fuel consumption and equivalent horsepower curves on the torque T versus rotation rate N plane of the engine common to the second and third embodiments of the present invention.

FIG. 6 shows an equivalent horsepower curve and an equivalent fuel consumption curve which are drawn on the torque T versus the engine rotation rate N plane where FC denotes the equivalent fuel consumption curve with the fuel consumption of 100% at the center thereof. $HP_S$ denotes the equivalent horsepower curve in the standard operation mode, $HP_B$ denotes the equivalent horsepower curve in the fine operation mode, and $T_S$ and $T_B$ respectively denote the engine torque on equivalent horsepower curves $HP_S$ and $HP_B$ where the minimum fuel consumption is achieved.

Figure 7:
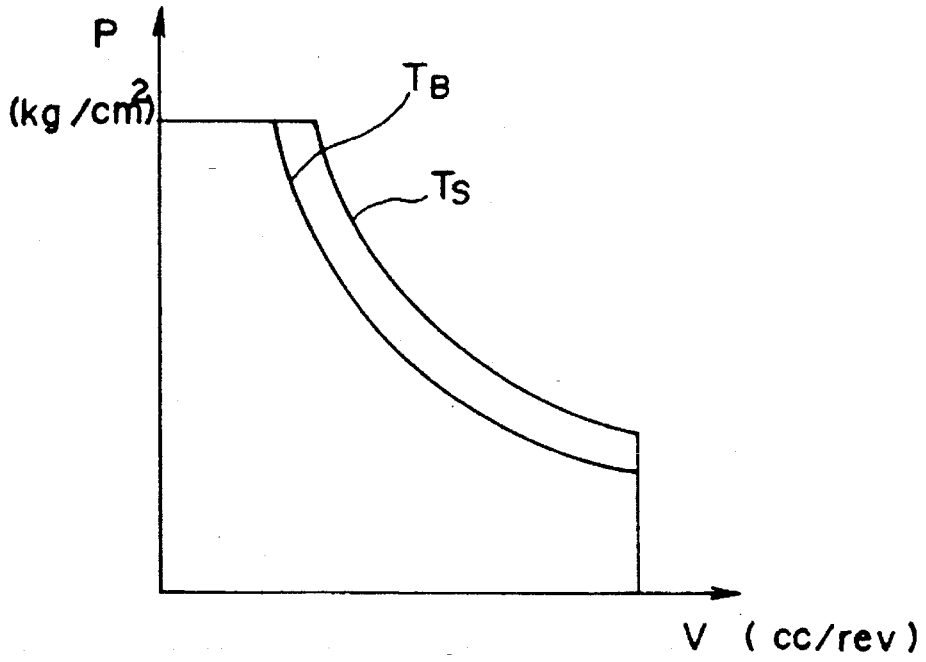
FIG. 7 is a diagram showing equivalent absorption torque curves on the hydraulic pressure P versus capacity V plane of the hydraulic pump common to the first and third embodiments of the present invention.
Figure 8:
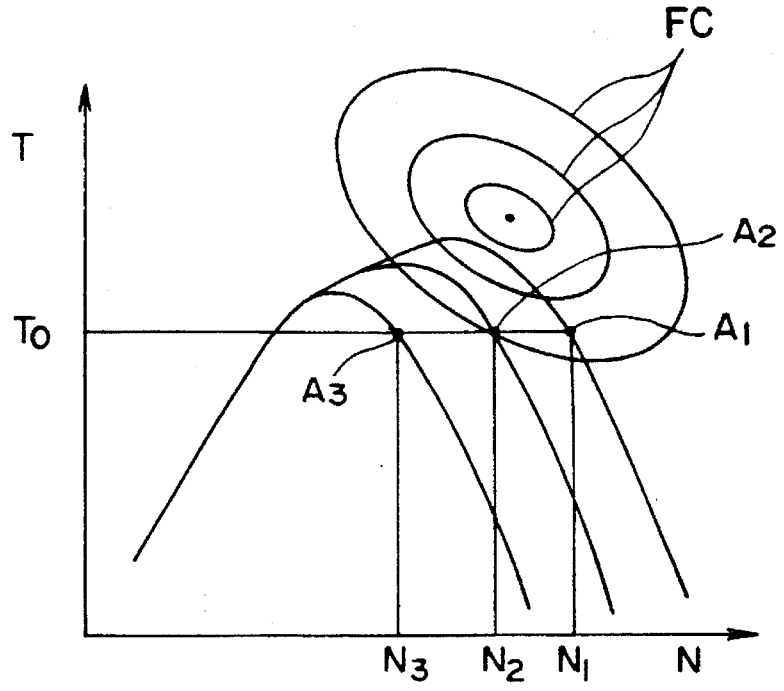
FIG. 8 PRIOR ART
FIG. 8 is a diagram showing the engine torque curves when the fuel injection quantity is varied in the prior art.
Figure 9:
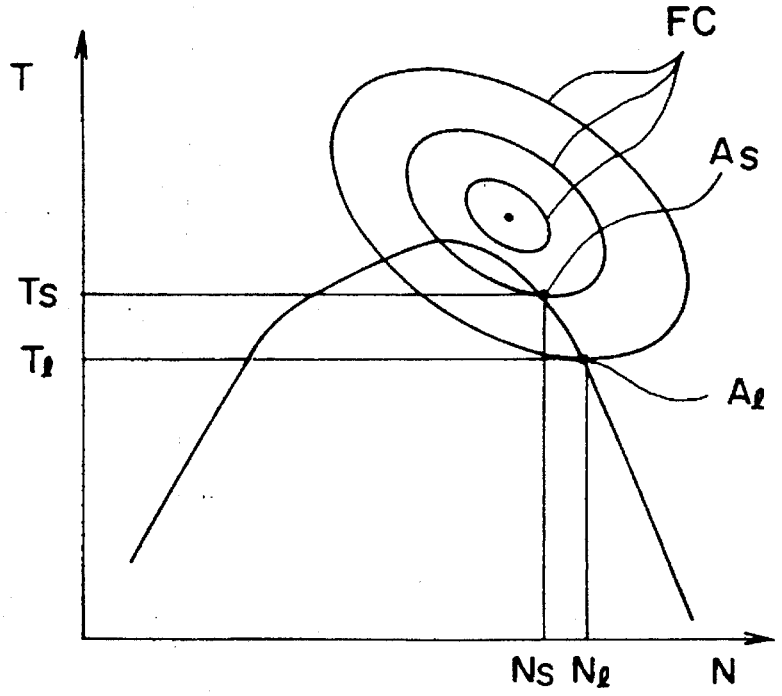
FIG. 9 PRIOR ART
FIG. 9 is a diagram showing the engine torque curve when the capacity of the hydraulic pump is varied while the fuel injection quantity is kept constant in the prior art.

FIG. 7 is a diagram showing an equivalent torque curve drawn on the hydraulic pressure P versus the capacity V plane of the hydraulic pump to be driven by the above described engine wherein $T_S$ and $T_B$ are respectively absorption torques of the hydraulic pump corresponding to the engine torques $T_S$ and $T_B$ shown in FIG. 6.

INDUSTRIAL APPLICABILITY

The present invention is to provide a useful fine operation changeover device for a hydraulic excavator, capable of conducting accurate work, for example, ground leveling or position adjustment on a dump vessel, while simply changing over a working machine such as a hydraulic excavator to the fine operation mode which is temporarily required, and improving operability and work efficiency by easily canceling the fine operation mode in the standard operation mode.

What is claimed is:

1. Apparatus comprising:

a variable capacity type hydraulic pump;

an engine for driving said hydraulic pump;

a governor drive unit for controlling said engine;

an actuator to be driven by said hydraulic pump;

a conduit connected between said hydraulic pump and said actuator;

an operating valve provided in said conduit so that the pressure in said conduit upstream of said operating valve is an upstream pressure and the pressure in said conduit downstream of said operating valve is a downstream pressure;

a load sensing control unit for changing the capacity of said hydraulic pump, with said upstream pressure and said downstream pressure as pilot pressures to said load sensing control unit, in response to a change in the difference between said pilot pressures;

a pump capacity sensor for determining the capacity of said hydraulic pump;

a rotation rate sensor for determining the rate of rotation of said engine;

a hydraulic pressure sensor for determining said downstream pressure;

a fine operation mode changeover switch; and a controller for receiving signals from said fine operation mode changeover switch, said pump capacity sensor, said rotation rate sensor, and said hydraulic pressure sensor; for calculating a pump capacity control signal responsive to signals from said fine operation mode changeover switch, said pump capacity sensor, and said hydraulic pressure sensor; for outputting said pump capacity control signal to said load sensing control unit for controlling the capacity of said hydraulic pump through said load sensing control unit; for calculating an engine control signal from signals from said fine operation mode changeover switch and said rotation rate sensor; and for outputting said engine control signal to said governor drive unit for operating said engine.

2. Apparatus in accordance with claim 1, wherein said controller calculates the pump capacity control signal and the engine control signal so that the engine is operated with minimum fuel consumption at a horsepower assigned by the fine operation mode changeover switch.

3. Apparatus in accordance with claim 1, wherein said pump capacity control signal is an electrical signal and is applied to a solenoid of the load sensing control unit.

4. Apparatus in accordance with claim 1, wherein the engine control signal is determined in accordance with an engine torque and an engine rotation rate which represent the minimum fuel consumption on an equivalent horsepower curve of the engine.

5. Apparatus in accordance with claim 1, wherein said fine operation mode changeover switch is provided on an operation lever for said actuator.

6. Apparatus comprising:

a variable capacity type hydraulic pump;

an engine for driving said hydraulic pump;

a governor drive unit for controlling said engine;

an actuator to be driven by said hydraulic pump;

a conduit connected between said hydraulic pump and said actuator;

an operating valve provided in said conduit so that the pressure in said conduit upstream of said operating valve is an upstream pressure and the pressure in said conduit downstream of said operating valve is a downstream pressure;

a load sensing control unit for changing the capacity of said hydraulic pump with said upstream pressure and said downstream pressure as pilot pressures to said load sensing control unit, in response to a change in the difference between said pilot pressures;

a pump capacity sensor for determining the capacity of said hydraulic pump;

a rotation rate sensor for determining the rate of rotation of said engine;

a hydraulic pressure sensor for determining said downstream pressure;

a fine operation mode changeover switch; and a controller for receiving signals from said fine operation mode changeover switch said pump capacity sensor, said rotation rate sensor, and said hydraulic pressure sensor; for calculating a pump capacity control signal responsive to signals from said fine operation mode changeover switch, said pump capacity sensor, and said hydraulic pressure sensor; for outputting said pump capacity control signal to said load sensing control unit for controlling the capacity of said hydraulic pump through said load sensing control unit; for calculating an engine control signal from signals from said fine operation mode changeover switch and said rotation rate sensor; and for outputting said engine control signal to said governor drive unit for operating said engine;

wherein said controller comprises a standard operation target value setter for setting a target engine rotation rate and a target engine torque for a standard operation mode; a fine operation target value setter for setting a target engine rotation rate and a target engine torque for a fine operation mode; a capacity difference calculator for receiving signals from said pump capacity sensor and said hydraulic pressure sensor and the target engine torque for one of the standard operation mode and the fine operation mode, and for calculating a capacity difference signal responsive thereto; a first control signal generator for converting the capacity difference signal to the pump capacity control signal and for outputting said pump capacity control signal to said load sensing control unit for controlling the capacity of said hydraulic pump through said load sensing control unit; an engine rotation rate difference calculator for receiving a signal from said rotation rate sensor and the target engine rotation rate for one of the standard operation mode and the fine operation mode, and for calculating an engine rotation rate difference signal responsive thereto; a second control signal generator for converting the engine rotation rate difference signal to the engine control signal and for outputting said engine control signal to said governor drive unit for operating said engine.

7. Apparatus in accordance with claim 6, wherein said first control signal generator is an increasing function generator, and wherein said second control signal generator is a decreasing function generator.

8. Apparatus in accordance with claim 6, wherein, when said fine operation mode changeover switch is actuated for the fine operation mode, said capacity difference calculator receives said target engine torque for the fine operation mode and said engine rotation rate difference calculator receives said target engine rotation rate for the fine operation mode; and wherein when said fine operation mode changeover switch is not actuated for the fine operation mode, said capacity difference calculator receives said target engine torque for the standard operation mode and said engine rotation rate difference calculator receives said target engine rotation rate for the standard operation mode.

9. Apparatus in accordance with claim 8, wherein said first control signal generator is an increasing function generator, and wherein said second control signal generator is a decreasing function generator.

10. Apparatus comprising:

a variable capacity type hydraulic pump;

an engine for driving said hydraulic pump;

a governor drive unit for controlling said engine;

an actuator to be driven by said hydraulic pump;

a conduit connected between said hydraulic pump and said actuator;

an operating valve provided in said conduit so that the pressure in said conduit upstream of said operating valve is an upstream pressure and the pressure in said conduit downstream of said operating valve is a downstream pressure;

a load sensing control unit for changing the capacity of said hydraulic pump with said upstream pressure and said downstream pressure as pilot pressures to said load sensing control unit, in response to a change in the difference between said pilot pressures;

a pump capacity sensor for determining the capacity of said hydraulic pump;

a rotation rate sensor for determining the rate of rotation of said engine;

a hydraulic pressure sensor for determining said downstream pressure;

a fine operation mode changeover switch: and a controller for receiving signals from said fine operation mode changeover switch, said pump capacity sensor, said rotation rate sensor, and said hydraulic pressure sensor; for calculating a pump capacity control signal responsive to signals from said fine operation mode changeover switch, said pump capacity sensor, and said hydraulic pressure sensor; for outputting said pump capacity control signal to said load sensing control unit for controlling the capacity of said hydraulic pump through said load sensing control unit; for calculating an engine control signal from signals from said fine operation mode changeover switch and said rotation rate sensor; and for outputting said engine control signal to said governor drive unit for operating said engine;

wherein said controller comprises:

a standard operation target value setter for setting a target engine rotation rate and a target engine torque for a standard operation mode;

a fine operation target value setter for setting a target engine rotation rate and a target engine torque for a fine operation mode;

a fine operation capacity difference calculator for receiving signals from said pump capacity sensor and said hydraulic pressure sensor and a target engine torque for the fine operation mode, and for calculating a capacity difference signal responsive thereto;

a standard operation capacity difference calculator for receiving signals from said pump capacity sensor and said hydraulic pressure sensor and a target engine torque for the standard operation mode, and for calculating a capacity difference signal responsive thereto;

a first control signal generator for converting a capacity difference signal from either one of said fine operation capacity difference calculator and said standard operation capacity difference calculator to the pump capacity control signal and for outputting said pump capacity control signal to said load sensing control unit for controlling the capacity of said hydraulic pump through said load sensing control unit;

a fine operation engine rotation rate difference calculator for receiving a signal from said rotation rate sensor and a target engine rotation rate for the fine operation mode, and for calculating an engine rotation rate difference signal responsive thereto;

a standard operation engine rotation rate difference calculator for receiving a signal from said rotation rate sensor and a target engine rotation rate for the standard operation mode, and for calculating an engine rotation rate difference signal responsive thereto;

a second control signal generator for converting the engine rotation rate difference signal from either one of said fine operation engine rotation rate difference calculator and said standard operation engine rotation rate difference calculator to the engine control signal and for outputting said engine control signal to said governor drive unit for operating said engine.

11. Apparatus in accordance with claim 10, wherein said first control signal generator is an increasing function generator, and wherein said second control signal generator is a decreasing function generator.

12. Apparatus in accordance with claim 10, wherein said controller calculates the pump capacity control signal and the engine control signal so that the engine is operated with minimum fuel consumption at a horsepower assigned by the fine operation mode changeover switch.

13. Apparatus in accordance with claim 12, wherein the engine control signal is determined in accordance with an engine torque and an engine rotation rate which represent the minimum fuel consumption on an equivalent horsepower curve of the engine.

14. Apparatus in accordance with claim 13, wherein said first control signal generator is an increasing function generator, and wherein said second control signal generator is a decreasing function generator.

15. Apparatus in accordance with claim 14, wherein said fine operation mode changeover switch is provided on an operation lever for said actuator.

16. Apparatus in accordance with claim 15, wherein said pump capacity control signal is an electrical signal and is applied to a solenoid of the load sensing control unit.

17. Apparatus in accordance with claim 10, wherein said pump capacity control signal is an electrical signal and is applied to a solenoid of the load sensing control unit.

18. Apparatus in accordance with claim 10, wherein the engine control signal is determined in accordance with an engine torque and an engine rotation rate which represent the minimum fuel consumption on an equivalent horsepower curve of the engine.

19. Apparatus in accordance with claim 10, wherein said fine operation mode changeover switch is provided on an operation lever for said actuator.

20. Apparatus in accordance with claim 10, wherein, when said fine operation mode changeover switch is actuated for the fine operation mode, said fine operation capacity difference calculator receives a target engine torque for the fine operation mode and said fine operation engine rotation rate difference calculator receives a target engine rotation rate for the fine operation mode; and wherein when said fine operation mode changeover switch is not actuated for the fine operation mode, said standard operation capacity difference calculator receives a target engine torque for the standard operation mode and said standard operation engine rotation rate difference calculator receives a target engine rotation rate for the standard operation mode.

* * * * *